United States Patent [19]

Barnard

[11] 4,175,309

[45] Nov. 27, 1979

[54] CONVEYORIZED FIN ACCUMULATOR

[75] Inventor: James A. Barnard, Olcott, N.Y.

[73] Assignee: General Motors Corporation, Detroit, Mich.

[21] Appl. No.: 915,891

[22] Filed: Jun. 15, 1978

[51] Int. Cl.[2] ..... B23P 15/26

[52] U.S. Cl. ..... 29/157.3 R; 29/157.3 B; 113/116 BB; 113/116 V; 113/116 Y; 113/118 V; 113/118 B

[58] Field of Search ..... 113/116 V, 116 Y, 116 BB, 113/11 A, 1 C, 118 A, 118 B, 118 V, 118 R; 29/157.3 R, 157.3 A, 157.3 B

[56] References Cited

U.S. PATENT DOCUMENTS

| | | | |
|---|---|---|---|
| 1,825,854 | 10/1931 | Coryell | 113/116 Y |
| 2,001,355 | 5/1935 | White | 113/116 V |
| 2,015,202 | 9/1935 | Stokes | 113/116 V |
| 2,335,292 | 11/1943 | Messenger | 113/116 V |

*Primary Examiner*—Francis S. Husar

*Assistant Examiner*—V. K. Rising

*Attorney, Agent, or Firm*—K. H. MacLean

[57] ABSTRACT

A method of forming elongated heat exchange fins from a continuous sheet of material having a width equal to a multiple of the width of a single fin and of collecting the fins in stacked relationship including the following steps: forming the sheet into longitudinally continuous adjacent fin strips with a width equal to the width of the fins, severing each fin strip into finite length fins with the ends in adjacent strips being longitudinally staggered and the ends in alternate strips being transversely aligned, progressing the finite length fins of alternate fin strips in a longitudinal direction, collecting the transversely aligned fins in the alternate fin strips moving the collected fins one fin width in the transverse direction, simultaneously progressing the finite fins of intermediate fin strips and stacking the finite fins of the intermediate fin strips over respective finite fins of the alternate fin strips on the respective finite fins of the alternate fin strips.

3 Claims, 2 Drawing Figures

CONVEYORIZED FIN ACCUMULATOR

This is a method for forming and collecting a plurality of elongated heat exchange fins from a continuous strip of sheet metal.

Fins for heat exchangers such as used in an automotive air conditioning condenser are normally formed from sheet material with the elongated dimension of the fins directed transversely to the length dimension of the sheet material. As the fins emerge from the fin forming apparatus in a direction normal to the elongated dimension of the fin, the fins are collected by stationary collecting means such as several vertically extending rods or pins. The rods or pins are positioned to extend through openings formed in the fin material which openings are subsequently used for accepting fluid conveying tubing. After a desired number of fins have been stacked on the pin collectors, the fin formation is interrupted while a new set of pin collectors are moved into place.

The aforedescribed fin forming and collecting apparatus utilizes an interrupted mode of operation which is inefficient as compared to a continuous forming and collecting mode. The subject invention discloses a method for continuously forming and collecting elongated fins for a heat exchanger. The fins are formed from a continuous length of sheet metal with the elongated dimension of the fin oriented parallel to the travel and to the length of the sheet metal coil. The coil is formed into strips or rows of fins, the strips having a width equal to the width of a fin. Also, alternate strips are severed into fins of finite length. The ends of the fins in alternate strips being aligned in the transverse direction with the ends of fins in intermediate strips being staggered in a longitudinal direction from fins in adjacent strips. As the fins are progressed after a forming step, the ends in the alternate strips extend forward of the ends in the intermediate rows. This spacing thus formed is advantageous for collection of the fins by continuous and laterally moving conveyor means. As one part of the conveyor moves across the width of the coil, fins are progressively stacked one upon another until the end stack has a number of fins equal to the number of fin strips.

Therefore, an object of the present invention is to provide a method of fin formation and collection including the orientation of fins with the ends in alternate fin strips aligned and with the fin ends in intermediate strips aligned with one another but staggered longitudinally with respect to fins in the alternate strips to space the emerging fins and thus facilitate the collection of the fins.

A still further object of the present invention is to provide a method of forming and collecting elongated fins which are oriented in side by side relation with the long dimension extending parallel to the progression of the fins and stacking the fins one on another as they move in a direction transverse to the movement of the uncollected fins.

Further objects and advantages of the present invention will be more readily apparent from the following detailed description, reference being had to the accompanying drawings in which a preferred embodiment of the invention is shown.

IN THE DRAWINGS

Figure 1:
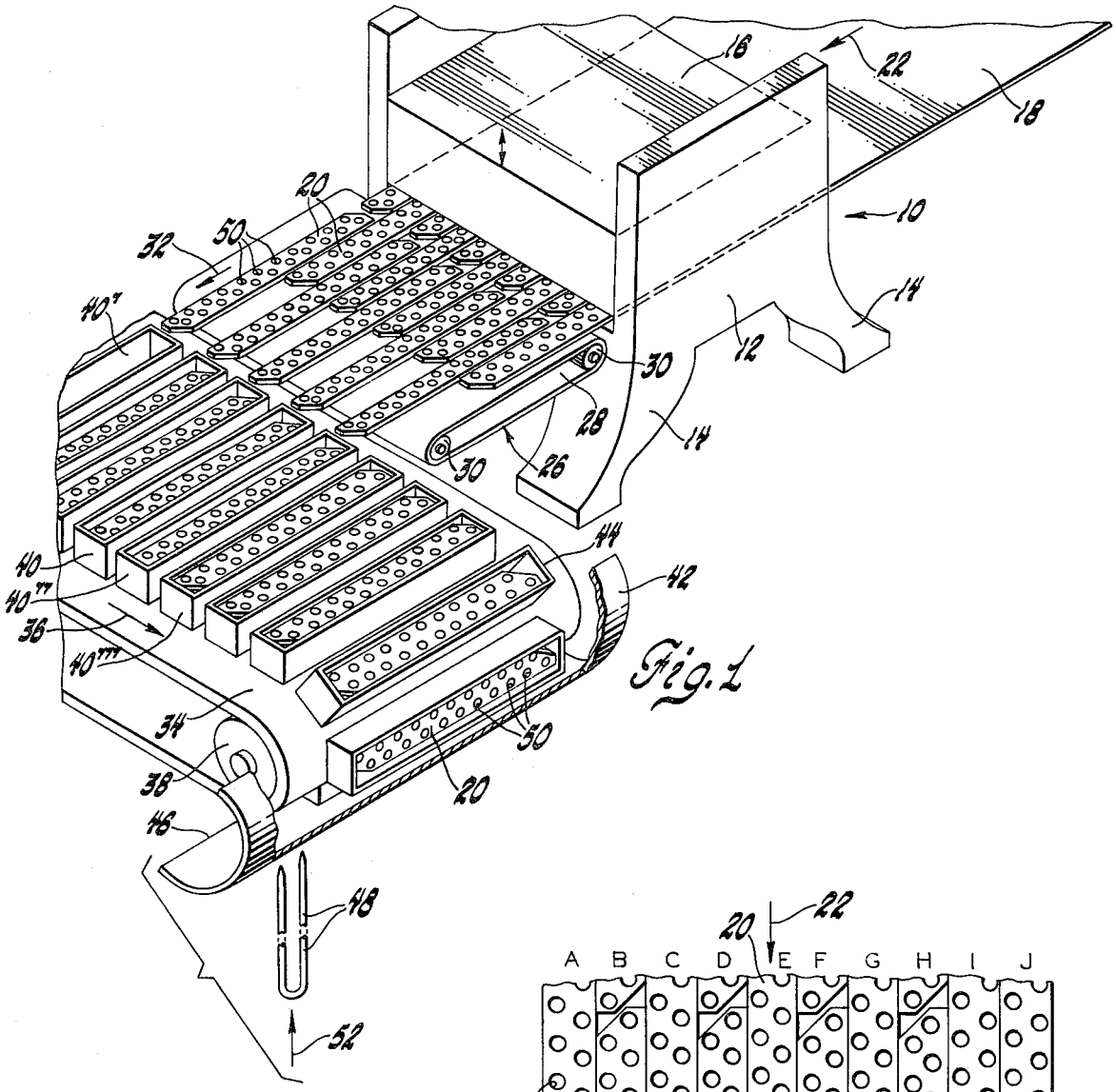
FIG. 1 is a perspective view of a fin forming press and a fin collecting apparatus in simplified form and broken away to reveal its functional mode of collecting fins in stacked relation by lateral movement of a collector.

In FIG. 1, a fin forming apparatus or press 10 is illustrated. The press 10 includes a solid base or support portion 12 from which legs 14 extend. The base 12 supports and regulates upward and downward movement of a fin forming member of die 16. A continuous sheet 18 of thin metal material such as aluminum, copper or brass is fed to one side of the apparatus 10 and the vertical, reciprocal movement of the member 16 forms a plurality of elongated fin members 20 which emerge from a second side of the apparatus 10 opposite to the one side.

Figure 2:
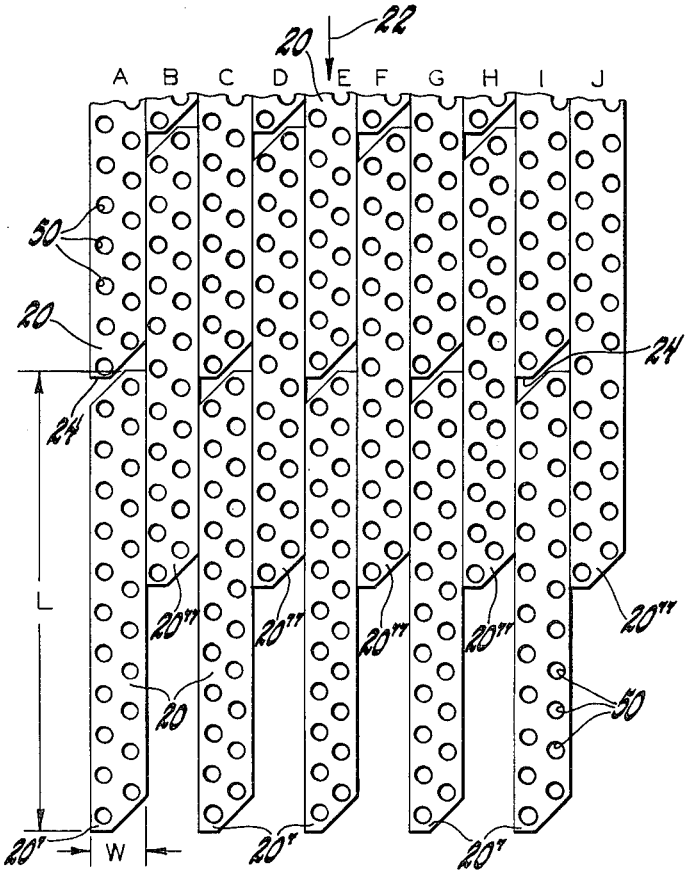
FIG. 2 is an enlarged planar view of the fin orientation as they progress from the fin forming apparatus and revealing the aligned fin ends of alternate fin strips and the staggered fin ends of intermediate fin rows.

The orientation of the formed fins are best shown in FIG. 2. The elongated fins have a length 'L' and a width 'W'. The width of the input sheet of material 18 is a multiple of the width 'W'. FIG. 2 illustrates the output from the apparatus 10 and the fins 20 are formed in strips or rows A–J. Each strip has a width 'W' equal to the fin width and with the fins oriented in end to end relation with the elongated dimension extending parallel to the direction of movement of the sheet 18 as indicated by the arrow 22 in FIGS. 1 and 2.

Each fin is formed into fins of finite length 'L' by cutting out a portion 24 periodically in each strip or row. It should be noted in FIG. 2 that the fin ends 20' of alternate strips A, C, E, G, and I are transversely aligned across the width of the fins. Likewise, the fin ends 20'' of intermediate strips or rows B, D, F, H and J are transversely aligned but offset or staggered longitudinally from the fin ends 20'.

Referring back to FIG. 1, it is apparent that the fins emerging from apparatus 10 are then supported by a continuous and moving conveyor means 26. This moves the fins in the longitudinal direction. Conveyor means 26 is shown rather schematically but includes a continuously moving belt portion 28 supported by rollers 30. Arrow 32 in FIG. 1 reveals the longitudinal direction of movement of the belt 28 and the fins 20 resting thereon.

The fins 20 are moved by the belt 28 to a transversely moving conveyor belt 34. The arrow 36 in FIG. 1 reveals the transverse direction. Roller 38 and a similar roller (not shown) at the other end of the conveyor belt 34 provides support. Mounted on the continuous conveyor are a plurality of spaced collector means 40. As illustrated in FIG. 1, the means 40 is in the form of buckets attached to the conveyor belt 34. The belt 34 moves to the position shown in FIG. 1 whereas the fins from the rows A, C, E, G and I are longitudinally aligned therewith. Subsequently, the conveyor 28 moves the fins in the direction of arrow 32 and they fall into the interiors or the collector means 40. Thereafter, the conveyor means 34 is moved in the transverse direction 36 a distance of one fin width 'W' so that the collector means 40 are then aligned with the fin strips B, D, F, H and J. Thereafter, the movement of the conveyor 28 in the direction 32 causes the fins from these rows to be placed in the collector means 40. After the first collector means 40' has progressed from the leftward position in FIG. 1 to the position now occupied by collector 40'' in FIG. 1, nine fins A–I are stacked in overlying relationship. One further movement to a position intermediate the positions of collector 40'' and collector 40''' and the collector has received fins from all the strips A–J (10 fins). Quite obviously, the apparatus 10 and its associated conveying means as well as the width of sheet 18 could be made wider to accommodate a greater number of fins thereacross. Nautrally, the more fin strips across the width of the sheet 18, the greater the number of fins collected in stacked relationship.

Once the buckets 40 are full further movement of the belt 34 from the position 40''' inverts the stacked fins. To prevent the fins from dropping out of the open ended buckets 40, a curved member 42 is supported in close proximity to the upper edges 44 of the collector buckets 40. The member 42 holds the stacked fins 20 in the buckets 40 until it moves past the position of the edge 46 on member 42. Thereafter, the stacked fins may be conveyed in the stacked relationship by apparatus not shown in these drawings or means can be employed to insert U-shaped tubes or "hairpins" 48 through the aligned holes 50 in the stacked fins. The tubes 48, only one of which is shown in FIG. 1, may be inserted in the direction of arrow 52 through the openings 50.

Although only one embodiment of an apparatus has been shown, several differing forms of the apparatus could be utilized to practice the specific method of forming and collecting fins which is the subject of this invention as described in the following claims.

I claim:

1. A method of forming elongated heat exchanger fins from a continuous sheet of material having a width equal to a multiple of the width of a single fin and for collecting the fins in stacked relationship comprising:

forming the sheet into longitudinally continuous adjacent fin strips with a width equal to the width of the fins, forming successive portions of each fin strip into integrally interconnected fins, severing each fin strip into adjacent finite fins with the fins in one strip being longitudinally staggered with respect to the fins in each adjacent strip and with the fins in alternate and intermediate strips being transversely aligned, simultaneously progressing the finite fins of the alternate and the intermediate fins strips in the longitudinal direction, collecting the transversely aligned fins of the alternate fin strips, moving the collected fins one fin width in the transverse direction, collecting the transversely aligned fins of the intermediate fin strips over the respective fins of the alternate fin strip.

2. A method of forming elongated heat exchanger fins from a continuous sheet of material having a width equal to a multiple of the width of a single fin and of collecting the fins in stacked relationship comprising:

forming the sheet into longitudinally continuous adjacent fin strips with a width equal to the width of the fins, forming successive portions of each fin strip into integrally interconnected fins, severing each fin strip into adjacent finite fins with the fins in one strip being longitudinally staggered with respect to the fins in each adjacent strip and with the fins in alternate and intermediate fin strips being transversely aligned, simultaneously progressing the finite fins of the alternate fin strips in a longitudinal direction, collecting the transversely aligned finite fins of the alternate fin strips, moving the collected fins one fin width in a transverse direction, simultaneously progressing the finite fins of the intermediate fin strips over respective fins of the alternate fin strips, and stacking the finite fins of the intermediate fin strips on their respective finite fins of the alternate fin strips.

3. A method of forming elongated heat exchanger fins from a continuous sheet of material having a width equal to a multiple of the width of a single fin and of collecting the fins in stacked relationship comprising:

forming the sheet into longitudinally continuous adjacent fin strips with a width equal to the width of the fins, forming successive portions of each fin strip into integrally interconnected fins, severing each fin strip into adjacent finite fins extending in alignment in a transverse direction thus forming end to end groups of transversely aligned fins, progressing the fins in a longitudinal direction, simultaneously collecting a first group of fins in side by side relation, moving the collected fins one fin width in a transverse direction, subsequently progressing a second group of transversely aligned fins over the fins of the first group and stacking the fins of the second group on the respective fins of the first group.

* * * * *